US005516370A

United States Patent [19]

Karnauchow et al.

[11] Patent Number: 5,516,370

[45] Date of Patent: May 14, 1996

[54] CAN ADAPTOR FOR FUEL SYSTEM CLEANING SOLVENT AND METHOD OF USING SAME

[76] Inventors: Leonid Karnauchow; Betty Karnauchow, both of Portion 38 Parish of Cope, Gulgong Road, Ulan, New South Wales 2850, Australia

[21] Appl. No.: 107,671

[22] PCT Filed: Feb. 14, 1992

[86] PCT No.: PCT/AU92/00056

§ 371 Date: Oct. 14, 1993

§ 102(e) Date: Oct. 14, 1993

[87] PCT Pub. No.: WO92/14916

PCT Pub. Date: Sep. 3, 1992

[30] Foreign Application Priority Data

Feb. 14, 1991 [AU] Australia ..... PK4610

[51] Int. Cl.[6] ..... B08B 9/00

[52] U.S. Cl. ..... 134/22.12; 134/22.18; 134/26; 134/169 a; 134/169 R; 123/198 A

[58] Field of Search ..... 134/169 A, 169 R, 134/20, 22.18, 22.12, 26, 39; 123/198 A

[56] References Cited

U.S. PATENT DOCUMENTS

| | | | |
|---|---|---|---|
| 1,787,360 | 12/1930 | Cowherd | 134/20 X |
| 4,784,170 | 12/1988 | Romanelli et al. | 134/169 A X |
| 4,909,207 | 3/1990 | Takano et al. | 134/20 X |
| 4,977,872 | 12/1990 | Hartopp | 134/169 A X |
| 5,257,604 | 11/1993 | Vataru et al. | 134/20 X |
| 5,287,834 | 2/1994 | Flynn | 134/169 A X |

FOREIGN PATENT DOCUMENTS

| | | |
|---|---|---|
| 0307204 | 3/1989 | European Pat. Off. . |
| 0364167 | 4/1990 | European Pat. Off. . |

*Primary Examiner*—David L. Lacey
*Assistant Examiner*—Sean Vincent
*Attorney, Agent, or Firm*—John Q. McQuillan

[57] ABSTRACT

An apparatus (1) is used for cleaning the fuel injection system of a motor vehicle. The apparatus (1) includes an adaptor body (3) which fits onto a container (2). The adaptor body (3) has an inlet port (6) and an outlet port (7) which connect the interior of the container (2) to the fuel system of the motor vehicle. The outlet port (7) has an extension pipe (16) which has an opening adjacent the bottom of the container (2) while the inlet port (6) opens adjacent the top of the container (2). The apparatus (1) is used to direct cleaning solvent (26) to the fuel system of the motor vehicle.

7 Claims, 2 Drawing Sheets

CAN ADAPTOR FOR FUEL SYSTEM CLEANING SOLVENT AND METHOD OF USING SAME

The present invention relates to fuel injection service units, and in particular, to a unit which is used to clean the fuel system of a motor vehicle.

BACKGROUND ART

When servicing fuel injected motor vehicles, to obtain a result that enables the user to clean the fuel system and fuel injectors of carbon deposits, and other impurities, such as water, expensive apparatus has been required. Complicated systems with a number of pumps where a solvent is mixed with the fuel prior to insertion into the fuel system ensure that the servicing and cleaning procedure is relatively difficult and expensive.

Another method of cleaning the fuel system of a fuel injected motor vehicle would to physically remove the fuel injectors and fuel system from the motor vehicle and clean the individual parts. This requires the costly and time-consuming dismantling of the fuel pump and injectors and is therefore not a cost effective proposition.

OBJECT OF THE INVENTION

It is an object of the present invention to provide a simple method and apparatus for servicing and cleaning fuel injection fuel systems which substantially overcomes or ameliorates the above mentioned disadvantages.

DISCLOSURE OF THE INVENTION

According to one aspect of the present invention there is disclosed an apparatus comprising a body connectable to the top of a container, said body having an inlet port and an outlet port communicating with the inside of said container, the inlet port having an opening into said container adjacent the top of said container while the outlet port is connected to a pipe which extends into said container and has an opening adjacent the bottom of said container, said apparatus being connectable into a fuel line of a motor vehicle, said inlet port being connectable on the fuel tank side and said outlet port being connectable on the engine side, wherein a cleaning fluid in said container is forced through said fuel system by the operation of the vehicle fuel pump to clean the system.

BRIEF DESCRIPTION OF THE DRAWINGS

Two embodiments of the present invention will now be described with reference to the drawings in which.

BEST MODE OF CARRYING OUT THE INVENTION

Figure 1:
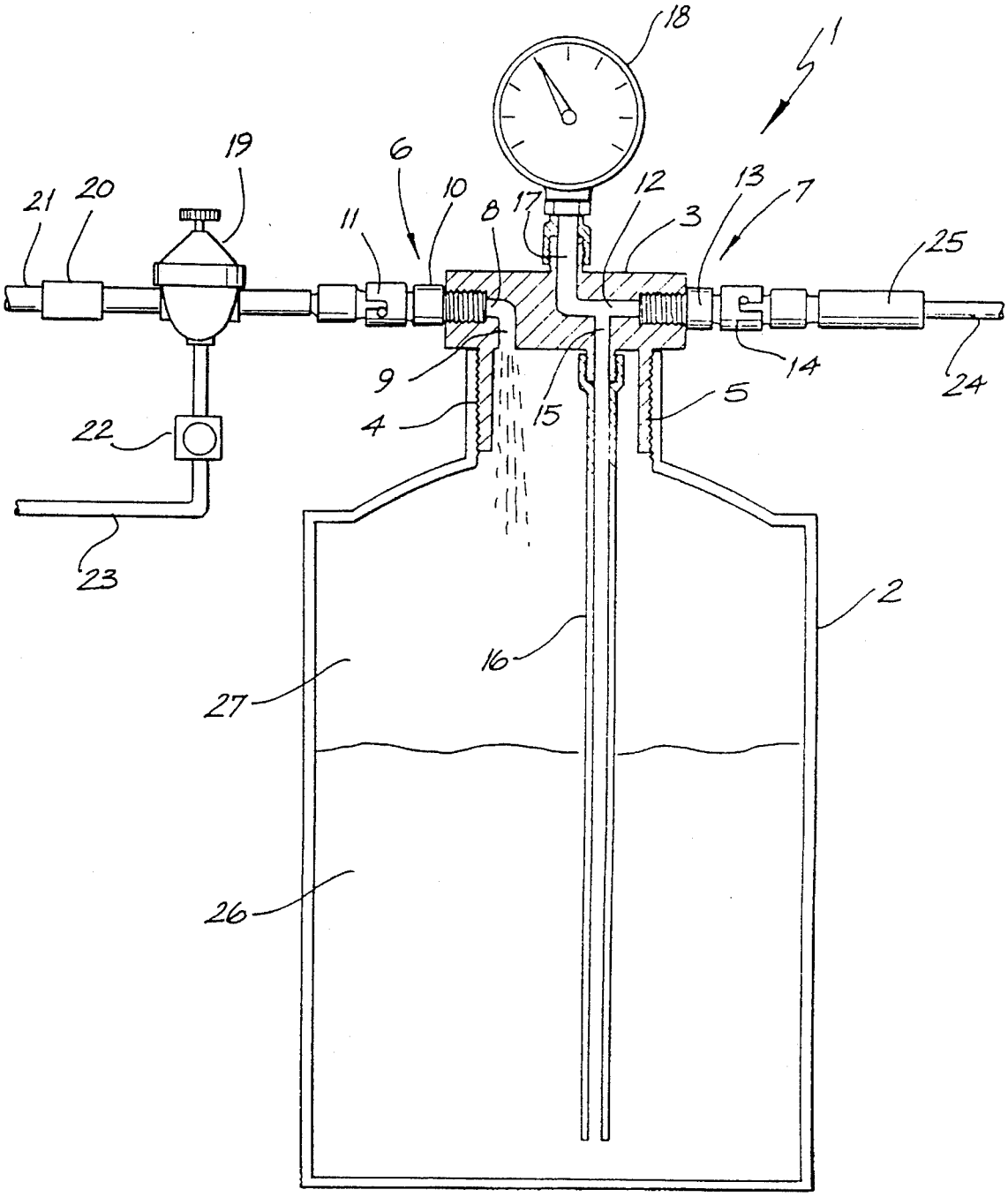
FIG. 1 is a schematic diagram of the apparatus of a first embodiment.

As illustrated in FIG. 1, the apparatus 1 includes a container 2 which is screw fitted to an adaptor body 3. The adaptor body 3 has a female thread 4 which is compatible with a reciprocal male thread 5 on the container 2. The adaptor body 3 therefore fits on the top of the container 2. The adaptor body 3 is a solid piece of metal and has an inlet port 6 and an outlet port 7 drilled and tapped therein. The inlet port 6 comprises a horizontal portion 8 and a vertical portion 9. The horizontal portion 8 is the portion which is tapped and has a screwed connector 10 which fits thereto. The connector 10 has a quick snap-on bayonet fitting 11 on the outside of the adaptor body 3. The vertical portion 9 of the inlet port 6 communicates with the interior of the container 2 when the adaptor body 3 is screwed thereon. The inlet port 6 has its opening adjacent the top of the container 2.

The outlet port 7 has a horizontal portion 12 which is tapped and has a screwed connector 13 onto which a similar bayonet fitting 14 is attached on the outside of the adaptor body 3. The outlet port 7 has one vertical portion 15 which connects to an extension pipe 16 which has an opening adjacent the bottom of the container 2. This means that the contents of the container 2 adjacent its bottom is what exits from the container 2 via the outlet port 7 during use.

The outlet port 7 has a second vertical portion 17 which is tapped and into which a pressure gauge 18 is screwed. The pressure gauge 18 is used to indicate the pressure in the outlet port 7.

As illustrated in FIG. 1, the apparatus 1 is connected into the fuel line 21, 24 of a motor vehicle (not illustrated). The apparatus 1 further includes a pressure regulator 19 which is snapped onto the bayonet fitting 11 of the inlet port 6. The pressure regulator 19 has a bayonet fitting 20 to which the fuel pressure line 21 from the fuel tank and fuel pump (not illustrated) is connected. The pressure regulator 19 is also connected via a flow restrictor valve 22 to a temporary return line 23 which returns fuel to the fuel tank (not illustrated). Connected to the outlet port 7 of the adaptor body 3 is the fuel line 24 of the motor vehicle via a visible in line flow rate meter 25 which is used to monitor the rate of flow and is able to detect colour changes in the flow of liquid in the fuel line 24. The fuel line 24 is connected to the engine (not illustrated).

In use the apparatus 1 is temporarily connected by a motor mechanic into the fuel pressure supply line of a fuel injected motor vehicle in the engine bay, directly before the motor vehicle fuel filter or directly after the motor vehicle fuel filter but always before the fuel injector rail by means of the bayonet fittings 20 and 14. The temporary return line 23 is fitted prior to the connection of the container 2 and is temporarily returned to the motor vehicle's fuel tank.

The container 2 which contains a cleaning solvent 26 is screwed tightly to the adaptor body 3 and the apparatus 1 is ready for use. Firstly, the return line (not illustrated) of the motor vehicle is cleaned by restricting the temporary return line 23 of the apparatus 1 and by operating the vehicle fuel pump (not illustrated) either by a jumper lead or by switching the vehicle ignition on and off without starting the engine. The solvent 26 will be forced out of the container into the fuel line 24 and through the motor vehicle's own pressure regulator back to the tank achieving the cleansing of the motor vehicle's return line to the injector rail, the injector rail itself, the motor vehicle's pressure regulator and the motor vehicle's return line. As the engine is not operating the solvent 26 is not forced into the fuel injectors of the motor vehicle.

By observing the visible flow rate meter 25, it is noticed that the liquid within the fuel line 24 changes when the solvent 26 in the container 2 has been used as the solvent 26 is a different colour to that of fuel 27. The colour change occurs as the fuel 27 is pumped via the vehicle fuel pump through the pressure line 21, the pressure regulator 19 into the inlet port 6. The fuel enters the container 2 at the top, and as the fuel has a density less than the solvent the fuel remains on top of the solvent within the container 2. As more fuel is pumped into the container 2 by the motor vehicle's fuel pump, the solvent 26 within the container 2 is forced through the extension pipe 16 and out of the container 2 via the outlet port 7 and through the fuel line 24 via the visible flow rate meter 25. Because the solvent 26 is coloured differently from the fuel 27, the complete removal of the solvent from the container 2 is easily observed.

When the solvent 26 has been completely pumped out of the container 2, this means that the solvent 26 has been forced into the motor vehicle fuel tank carrying any dissolved impurities with it back to the fuel tank. Any solid materials will be trapped in the motor vehicle fuel filter. This procedure ensures that no solid material will be forced into the fuel injectors of the motor vehicle.

Once this procedure has been completed, the temporary return line 23 is opened and the motor vehicle's own pressure regulator (not illustrated) stops the return flow from the apparatus 1 to the fuel tank of the motor vehicle.

The container 2, which now contains only fuel, is unscrewed and second container 2 having a second type of solvent 26 is substituted. Then a further procedure is commenced. The motor mechanic starts the engine of the motor vehicle, and fuel pressure is applied from the motor vehicle's own fuel pump to the apparatus 1. The pressure within the fuel system can be adjusted as required by the flow restrictor valve 22 of the temporary return line 23. The fuel pressure is able to be monitored by the pressure gauge 18 at the same time as the solvent 26 flowing in the visible flow rate meter 25 is observed. The mechanic is able to ensure by using the correct pressure that the solvent 26 will flow through the fuel injectors of the motor vehicle rather than pass through the motor vehicle's pressure regulator. The solvent 26 is used to clean the fuel injectors together with the vehicles fuel lines. Once the solvent 26 within the container 2 has been used, the mechanic can stop the motor vehicle's engine and remove the apparatus as the cleaning operation is completed.

Figure 2:
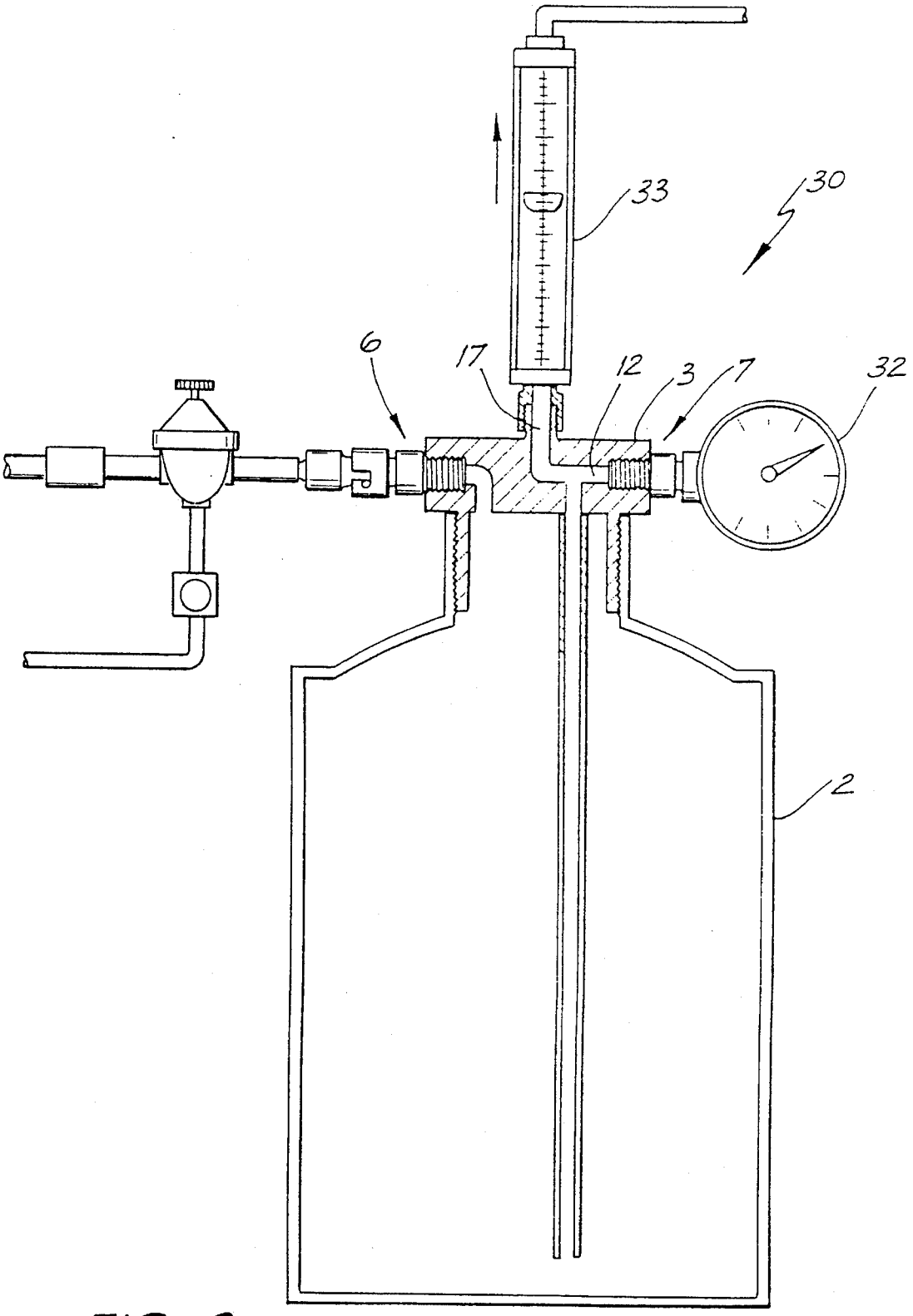
FIG. 2 is a schematic diagram of the apparatus of a second embodiment.

Another embodiment of the present invention is illustrated in FIG. 2. In this embodiment, the apparatus 30 includes the container 2, and adaptor body 3 as previously described. The adaptor body 3 includes the inlet port 6 and outlet port 7 as previously described. However, a pressure gauge 32 is connected to the horizontal portion 12 of the outlet port 7 while a visible through flow meter 33 is screw connected into the vertical portion 17 of the outlet port 7. The inlet port is connected as previously described in the first embodiment with the fuel line 21 and pressure regulator 19 connected thereto.

The apparatus 2 is able to be used in a similar manner to the previously described embodiment, and can also be used to check other operations of the fuel injection system.

The foregoing describes only one embodiment of the present invention and modifications, obvious to those skilled in the art, can be made thereto without departing from the scope of the present invention.

We claim:

1. A method of cleaning a fuel injection system of the engine of a motor vehicle by apparatus having a body connected to the top of a container, the body having an inlet port and an outlet port communicating with the inside of the container, the inlet port having an opening into the container adjacent the top of the container and the outlet port connected to a pipe which extends into the container, the method comprising the steps of:

installing the apparatus into the fuel injection system of a motor vehicle such that the inlet port is connected to the fuel system by a pressure regulating means on the fuel tank side, the outlet is connected to the fuel system on the engine side which includes an injector rail, injectors connected thereto, a pressure regulator connected to the injector rail, and a return from the engine pressure regulator connected to the fuel tank, and a return line including a flow restrictor connected to the pressure regulating means and the fuel tank;

connecting said body to the top of a container holding a first solvent;

closing the return line by the flow restrictor; and pumping the first solvent through the fuel system by operation of only the fuel pump of the fuel system without starting the engine, the solvent having a pressure due to the closed return line sufficient to cause the engine pressure regulator to bypass the injectors of the fuel system of the unstarted engine and return the solvent to the fuel tank.

2. The method according to claim 1 comprising the further steps of:

pumping a second solvent through the fuel system during operation of the engine of the vehicle and thereby during operation of the injectors of the fuel system; and controlling pressure of the second solvent within the fuel system by adjustment of the flow restrictor such that the pressure of the second solvent is maintained at a pressure insufficient for the second solvent to be returned by the engine pressure regulator to the fuel tank in order that the second solvent passes through the fuel injectors.

3. A method of cleaning a fuel injection system of the engine of a motor vehicle by an apparatus having a body connectable to the top of a container, the body having an inlet port and an outlet port communicating with the inside of the container, the inlet port having an opening into the container adjacent the top of the container and the outlet port being connected to a pipe which extends into the container and has an opening adjacent the bottom of the container, the method comprising the steps of:

installing the apparatus into the fuel injection system such that the inlet port is connected to the fuel system by a pressure regulating means on the fuel tank side, the outlet is connected to the fuel system on the engine side which includes an injector rail, injectors connected thereto, a pressure regulator connected to the injector rail, and a return from the engine pressure regulator connected to the fuel tank, and a return line including a flow restrictor is connected to the pressure regulating means and the fuel tank;

connecting said body to the top of a container having a solvent therein; and pumping the solvent through the fuel system including the injectors of the fuel system during operation of the engine of the motor vehicle and thereby during operation of the injectors of the fuel system at a pressure controlled by the flow restrictor which is insufficient for the solvent to be returned by the engine pressure regulator to the fuel tank.

4. Apparatus for cleaning the fuel system of the engine of a motor vehicle, the fuel system of the engine of the motor vehicle having a fuel pressure supply system including a fuel pressure line connected by a fuel pump to the fuel tank thereof, and having an engine fuel system connectable to the fuel pressure supply system and including an engine fuel line, a fuel injector rail, engine fuel injectors connected to the fuel injector rail, an injector rail return line connected to the fuel injector rail, a fuel system pressure regulator connected to the fuel injector rail, and a fuel system return line connected between the fuel system pressure regulator and the fuel tank, the apparatus comprising a body having an opening therein being connectable to the open top portion of a container, the body having an inlet port and an outlet port each extending from the exterior of the body to the opening in the body for communicating through the open top portion of the container with the interior of the container when the opening of the body is connected to the open top portion of the container, the container being adapted initially to hold a cleaning fluid and subsequently to hold an additional cleaning fluid, a pipe connected at one open end portion thereof to the outlet port in the opening of the body and being extendable into the container with the opposite other end portion of the pipe disposed adjacent the bottom of the container when the pipe is extended thereinto, the apparatus further comprising an adjustable pressure regulating means having an inlet connectable to the fuel pressure line and thereby to the fuel tank of the motor vehicle and an outlet connected to the inlet port at the exterior of the body of the apparatus, the outlet port at the exterior of the body of the apparatus being connectable to the engine fuel line, the adjustable pressure regulating means enabling the pressure of the fuel applied to the inlet port of the body of the apparatus to be adjusted, the adjustable pressure regulating means having an additional outlet, a flow restrictor valve having an inlet and an outlet with the inlet connected to the additional outlet of the adjustable pressure regulating means, the flow restrictor valve being alternately adjusted to restrict flow and to permit flow from the inlet to the outlet thereof, a temporary return line connected at one end thereof to the outlet of the adjustable pressure regulating means and being connectable at the other end thereof to the fuel tank of the motor vehicle, when a cleaning fluid is disposed in the container, the cleaning fluid being forced from the container and through the fuel system by the operation of the fuel pump of the engine to clean the fuel system, whereby adjusting the flow restrictor valve of the apparatus to restrict flow to the temporary return line, and adjusting the pressure regulating means to establish a pressure at the outlet port of the body of the apparatus which is sufficient for the cleaning fluid to be returned by the fuel system pressure regulator to the fuel tank, upon operating the fuel pump, the cleaning fluid is pumped out of the container, into the fuel injector rail, through the injector rail return line, through the fuel system pressure regulator, and through the fuel system return line to the fuel tank, and whereby after the cleaning fluid in the container has been pumped therefrom and filled with an additional cleaning fluid, the flow restrictor valve of the apparatus is adjusted to permit flow to the temporary return line, the pressure regulating means is adjusted to establish a pressure at the outlet port of the body of the apparatus which is insufficient for the additional cleaning fluid to be returned by the fuel system pressure regulator to the fuel tank, and the fuel pump is operated, thereupon the additional cleaning fluid is pumped out of the container, into the fuel injector rail, and through the fuel injectors as the engine is operated, while by-passing the fuel system pressure regulator.

5. The apparatus according to claim 4, wherein a pressure gauge means is connected to the outlet port to monitor the pressure of the cleaning fluid within said apparatus.

6. The apparatus according to claim 4, wherein a visual flow indication means is connected to said outlet port to give a visual indication of the cleaning fluid flowing within said apparatus.

7. The apparatus according to claim 6 wherein said visual flow indicating means also comprises means for providing a flow rate reading.

* * * * *